US006192946B1

(12) United States Patent
Clüsserath

(10) Patent No.: US 6,192,946 B1
(45) Date of Patent: Feb. 27, 2001

(54) BOTTLING SYSTEM

(75) Inventor: Ludwig Clüsserath, Bad Kreuznach (DE)

(73) Assignee: KHS Maschinen- und Anlagenbau AG, Dortmund (DE)

( * ) Notice: Subject to any disclaimer, the term of this patent is extended or adjusted under 35 U.S.C. 154(b) by 0 days.

(21) Appl. No.: 09/373,132

(22) Filed: Aug. 12, 1999

(30) Foreign Application Priority Data

Aug. 12, 1998 (DE) ..... 198 36 500

(51) Int. Cl.[7] ..... B65B 1/04

(52) U.S. Cl. ..... 141/40; 141/48; 141/49; 141/63

(58) Field of Search ..... 141/39, 40, 44–50, 141/63, 5–7

(56) References Cited

U.S. PATENT DOCUMENTS 5,082,033 * 1/1992 Weiss ..... 141/39
5,634,500 * 6/1997 Clusserath et al. ..... 141/48

* cited by examiner

*Primary Examiner*—Steven O. Douglas
(74) *Attorney, Agent, or Firm*—Nils H. Ljungman & Associates

(57) ABSTRACT

A bottling system for filling bottles or similar containers with a liquid product has a plurality of filling elements. Each filling element has a liquid valve for the controlled dispensing of the product as well as a plurality of gas ducts realized in a housing of the filling element, which gas ducts can be controlled by at least three separate and individually controlled control valves for each filling element, whereby the bottling method can be changed from an unpressurized bottling, bottling under counter pressure using the single-chamber bottling principle, as well as bottling under counter pressure using the three-chamber bottling pressure, essentially merely by modifying the control program.

20 Claims, 4 Drawing Sheets

N
13'
3
13"
1
2
16
17
18
13
22
25
14
15
8
5
B
41
10
6
A
4
31
32
33
34
30
39
40
46

35
37
36
31
38
32
33
13"
N
13'
1
3
30
39
16
2
13
22
17
25
18
9
5
8
41
10
6
4
46

BOTTLING SYSTEM

BACKGROUND OF THE INVENTION

1. Field of the Invention

The present invention relates to a bottling system to fill bottles or similar containers with a liquid product.

2. Background Information

Known devices describe a wide variety of bottling systems of this type, in particular systems for unpressurized bottling, systems for bottling under counter pressure using the single-chamber principle, as well as bottling under counter pressure using the three-chamber principle.

OBJECT OF THE INVENTION

An object of the present invention is to describe a bottling system with which different bottling methods can be employed easily and without any great effort or expense, and ultimately merely by modifying the control program.

SUMMARY OF THE INVENTION

The invention teaches that this object can be accomplished by a bottling system to fill bottles or similar containers with a liquid product, with a plurality of filling elements, with d common product chamber for at least one group of filling elements, with a common first and second gas chamber for at least one group of filling elements, and a liquid duct that is realized in a housing of each filling element. The duct is in communication with the product chamber and empties into a fill tube that forms a discharge opening for the product, which fill tube projects beyond a container stop and/or centering device formed on the filling element. A liquid valve in the liquid duct can be individually actuated by means of an actuator element by a central control device at least for a group of filling elements, each of which can be actuated individually, and namely for an opening in the filling phase and for a closing at the end of the filling phase. A gas duct that is realized in the housing of each filling element is in communication with a gas duct orifice that is provided on the container stop and is offset with respect to the fill tube, and when the container is placed in sealed contact with the filling element is in communication with the interior of the container. The system also contains at least a first, second and third control valve, each of which can be actuated individually by the control device, to control gas paths that are realized in the housing of each filling element, whereby a first control valve can be in communication on the input side via a first gas path with an area of the liquid duct that can be downstream of the liquid valve in the direction of flow of the product. The first valve can be connected on the output side to the gas duct, a second control valve can be connected on the input side to a second gas path leading to the first gas chamber, and on the output side to the gas duct, and a third control valve can be connected on the input side to the gas duct and on the output side to a third gas path leading to the second gas chamber. Between the gas duct and the third gas path or the second gas chamber, there can be a fourth gas path which can have a pressure control valve, which, if the differential pressure applied to the pressure control valve exceeds a specified threshold, can open to allow a flow out of the gas duct into the third gas path or into the second gas chamber.

The system claimed by the invention makes possible an unpressurized bottling and also makes it possible with little effort or expense, and ultimately merely by modifying the control program, to conduct bottling operations under counter pressure using the single-chamber bottling principle and also bottling operations under counter pressure using the three-chamber principle.

The subclaims and features disclose refinements of the invention.

The above discussed embodiments of the present invention will be described further hereinbelow with reference to the accompanying figures. When the word "invention" is used in this specification, the word "invention" includes "inventions", that is, the plural of "invention". By stating "invention", the Applicants do not in any way admit that the present application does not include more than one patentably and non-obviously distinct invention, and maintains that this application may include more than one patentably and non-obviously distinct invention. The Applicants hereby assert that the disclosure of this application may include more than one invention, and, in the event that there is more than one invention, that these inventions may be patentable and non-obvious one with respect to the other.

BRIEF DESCRIPTION OF THE DRAWINGS

The invention is explained in greater detail below with reference to the exemplary embodiments illustrated in the accompanying drawings.

DESCRIPTION OF THE PREFERRED EMBODIMENT

Figure 1:
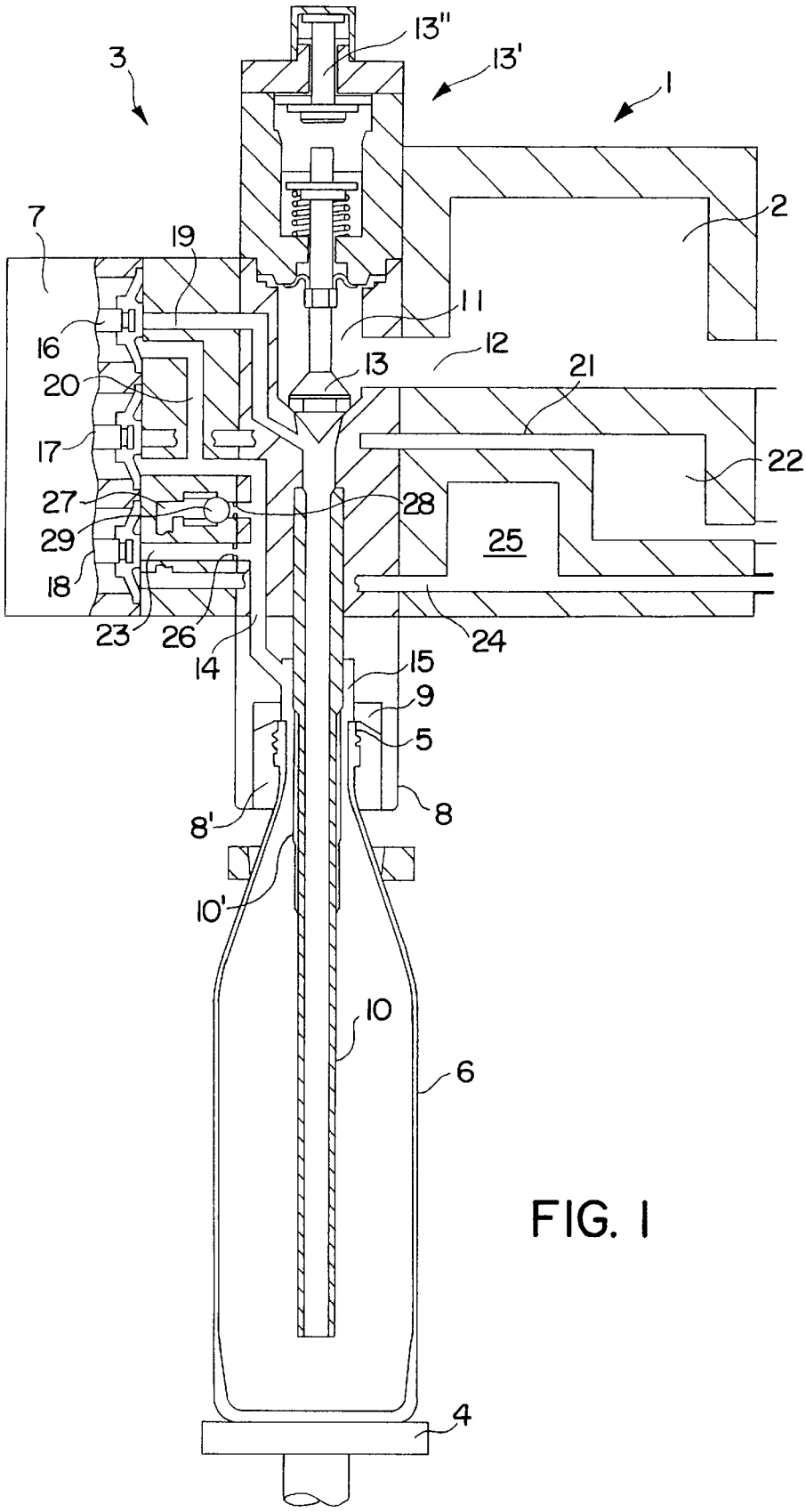
FIG. 1 is a simplified illustration in vertical section of one of the filling elements of a bottling system or of a rotating or revolving bottling machine, together with a container in the form of a bottle attached to the filling element.

In FIGS. 1–4, is a toroidal bowl or vessel of a bottling machine, which toroidal vessel is, in a known manner, a component of the rotor of this machine, which rotor rotates around the vertical machine axis. When the bottling machine is in operation, the interior 2 of the toroidal bowl 1 is essentially completely filled with the respective liquid product (beverage), as will be explained below in greater detail.

On the periphery of the toroidal bowl 1, distributed at regular angular intervals around the machine axis are filling elements 3, each of which, together with a bottle plate or support carrier 4 that can be raised and lowered forms a bottling point, namely for the filling of a respective bottle 6 standing with its base on the bottle plate 4 and attached by the latter with its mouth 5 against the filling element 3.

The filling elements 3 are realized in the form of long-tube filling elements and have a fill tube 10 that extends downward beyond the underside of the filling element housing 7 or a centering element 8 with a gasket 9 formed at that point, which fill tube, when the bottle 6 is attached to the filling element 3, extends into the interior of this bottle to the vicinity of the bottom of the bottle. In the housing 7 there is a liquid duct 11, one end of which duct 11 is in communication by means of a passage 12 with the interior 2 of the toroidal bowl 1. The other end of the liquid duct is in communication in the interior of the housing 7 with the upper end of the fill tube 10 that is open on both ends. Furthermore, in the liquid duct 11, there is a liquid valve 13 that is formed by a valve body with a tappet, which valve can be actuated by the tappet by means of a pneumatic actuator device 13'.

In the housing 7, there is, among other things, a gas duct 14 that makes a transition into an open, annular orifice 15 that concentrically surrounds the fill tube 10 and is open in the centering element 8 or at the gasket 9. By means of the orifice 15, when a bottle 6 is pressed in sealed contact against the filling element 3, the gas duct 14 is in communication with the interior of the bottle, and is sealed with respect to the external environment.

Each filling element 3 also has three individually controllable and pneumatically actuated control valves 16, 17 and 18, which are connected as follows:

Control Valve 16 Input side: By means of a duct 19 with the liquid duct 11, and in particular in the area between the liquid valve 13 and the fill tube 10, i.e. in the direction of flow of the product toward the liquid valve 13. Output side: With the one end of a duct 20. the other end of which empties into the gas duct 14.

Control Valve 17 Input side: With the one end of a duct 21, the other end of which is connected to a first toroidal duct 22 that is realized in the toroidal bowl 1 and is common to all the filling elements 3. Output side: With the gas duct 14.

Control Valve 18 Input side: With the one end of a duct 23, which empties with its other end into the gas duct 14. Output side: With the one end of a duct 24, which is in communication with its other end with a second toroidal duct 25 realized in the toroidal bowl 1 and common to all of the filling elements 3 of the bottling machine.

In the duct 23 there is a throttle or nozzle 26 which has a defined cross section to produce a defined throttling action.

An additional duct 27 that is realized in the housing 7 connects the duct 24 with the gas duct 14. In the duct 27, in series, there are a second throttle 28 and a pressure regulation or control valve 29. The latter valve is also realized so that it blocks a flow out of the duct 24 into the gas duct 14, but allows a flow in the opposite direction as long as the pressure difference at the valve is above a specified threshold. Like the liquid valves 13, the control valves 16–18 are computer-controlled, i.e. these valves are controlled as a function of the control program of a central computer or a central control device of the bottling machine. In the accompanying figures, this control device is designated 46 in general.

As FIG. 1 also shows, the actuator device 13' has a limiting cylinder 13" which can be actuated pneumatically and is likewise individually controlled by the central control device 46 of the bottling machine. In FIG. 1, this limiting cylinder is shown in the non-activated state, so that when the actuator device 13' is activated accordingly, the liquid valve can be opened all the way. If the limiting cylinder 13" is activated, it forms a stop for the tappet of the liquid valve 13 so that when the actuator device 13' is activated, the liquid valve 13 is opened only with a limited valve travel, i.e. Only partly or with a reduced cross section.

The bottling system described including the filling elements 3 and the toroidal bowl 1 with the interior 2 and the toroidal ducts 22 and 25 has the advantage, among other things, that it can be used in different bottling methods, namely, among others, an unpressurized bottling (FIG. 2), a single-chamber pressurized bottling (FIG. 3) and a three-chamber pressurized bottling, and that the conversion between these different bottling methods can be made without major expense or effort, essentially only by modifying the control program for the actuation of the liquid valves 13 and control valves 16–18 of the filling element 3.

The bottling system can therefore be used, if necessary, for the bottling of still beverages, but also, for example, for bottling products containing $CO_2$. Different bottling machines are therefore no longer necessary for this purpose.

The bottling system in accordance with the present invention also conforms to high health and microbiological standards, because there are no mechanically complex components or components that are difficult to clean in the liquid duct 11 and the fill tube 10. Likewise, there are essentially no components in the gas connections, namely the gas duct 14, the ducts 19, 20, 21, 23, 24 and 27 and the toroidal ducts 22 and 25, which can therefore be cleaned easily and reliably.

The pneumatically actuated control valves 16–18 as well as the actuator device 13' for the liquid valve are also completely sealed by means of membranes.

An additional advantage of the bottling system described is that the interior 2 of the toroidal bowl 1 is completely filled with the liquid product during operation, so that deposits in the interior 2 of the toroidal bowl 1, in particular when the liquid being bottled is hot, can be prevented, of the type that occur in known bottling systems in the toroidal bowl at the phase boundary between the liquid product and the gas space above it and are difficult to remove.

In other words, deposits in the interior of the toroidal bowl which can occur particularly when the liquid being bottled is hot, can be substantially prevented. Particularly, difficult to remove deposits of the type that occur in bottling systems of the prior art in the toroidal bowl at the phase boundary between the liquid product and the gas space above it.

In the bottling method described below in connection with FIGS. 2 and 3, the interior 2 of the toroidal bowl 1 is connected with a separate external reservoir 30 that is located next to the bottling machine, which is filled with the liquid product up to a level N that is significantly above the maximum level of the product in the bottle 6 on the filling element 3. By means of a level controller 31, which has among other things a level meter 32 and a control valve 33 in a supply line 34 for the liquid product, the level N is kept substantially constant. The maintenance of the correct and substantially constant level N in the reservoir 30 is also guaranteed by the relatively large surface area of the product in the reservoir 30, and namely even at very high product throughputs, of the type found in high-capacity bottling machines.

For non-pressurized bottling or bottling under atmospheric conditions, the essentially constant level N also results in a very constant static pressure of the product in the interior 2 of the toroidal bowl and thus a substantially uniform, repeatable bottling speed in all the phases of the bottling operation, as well as good bottling quality and correct fill heights.

In the interior of the reservoir 30 there are also spray heads, so that the interior of the reservoir 30 can be included in the CIP cleaning of the bottler.

For the single-chamber pressurized filling process, i.e. when carbonated beverages, for example, are being bottled under pressure, there is an additional pressure regulator 35 on the reservoir 30, namely consisting essentially of a pressure sensor 36 to measure the gas pressure in the gas space above the level N, and a control valve 37 controlled by the pressure sensor 36, which control valve 37 is located in a supply line 38 that empties into the gas space of the reservoir 1t above the level N and is connected with a source for an inert gas, such as carbon dioxide gas, under pressure.

If the product to be bottled is not oxygen-sensitive or is only negligibly oxygen-sensitive, instead of an inert gas under pressure, air under pressure can be used as a pressure medium in the gas space of the reservoir 30.

The gas space formed above the level N in the vessel 30 is also in communication via a separate duct 39 with the toroidal duct 22. By means of this duct, for example, the preliminary pressurization of the bottle 6 can occur in the single-chamber pressurized filling. During this pressurized bottling, the duct 39 can also be used, for example, for the depressurization and for the return gas removal as the filling proceeds, and namely in particular with carbonated products that have a high microbiological stability.

For the bottling of non-carbonated products that are subject to microbiological spoilage, the depressurization and the return gas-removal take place via the duct 39 preferably only if a protective gas pressurization is provided during the filling.

Figure 2:
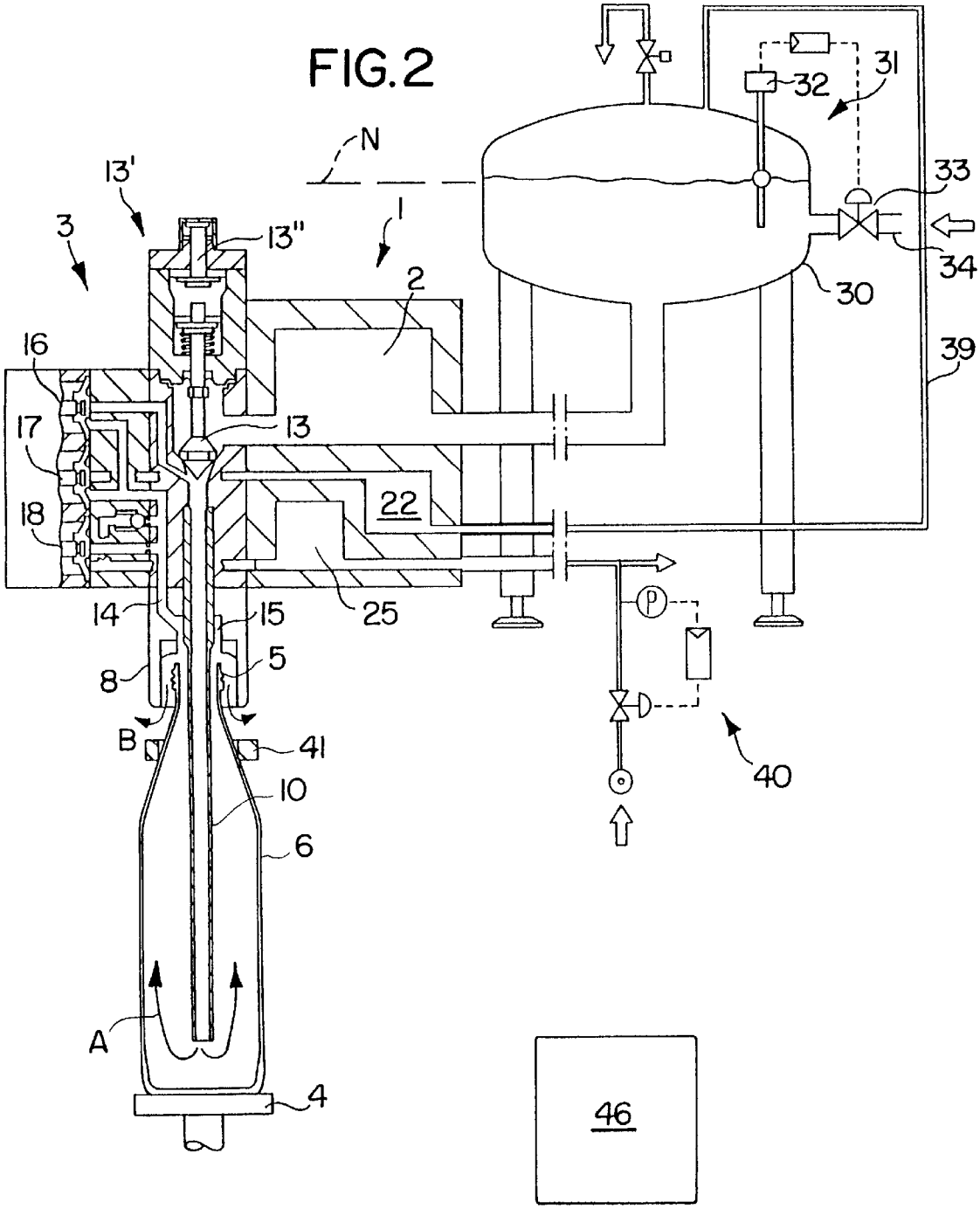
FIG. 2 shows the filling element illustrated in FIG. 1 as used for unpressurized bottling.
Figure 3:
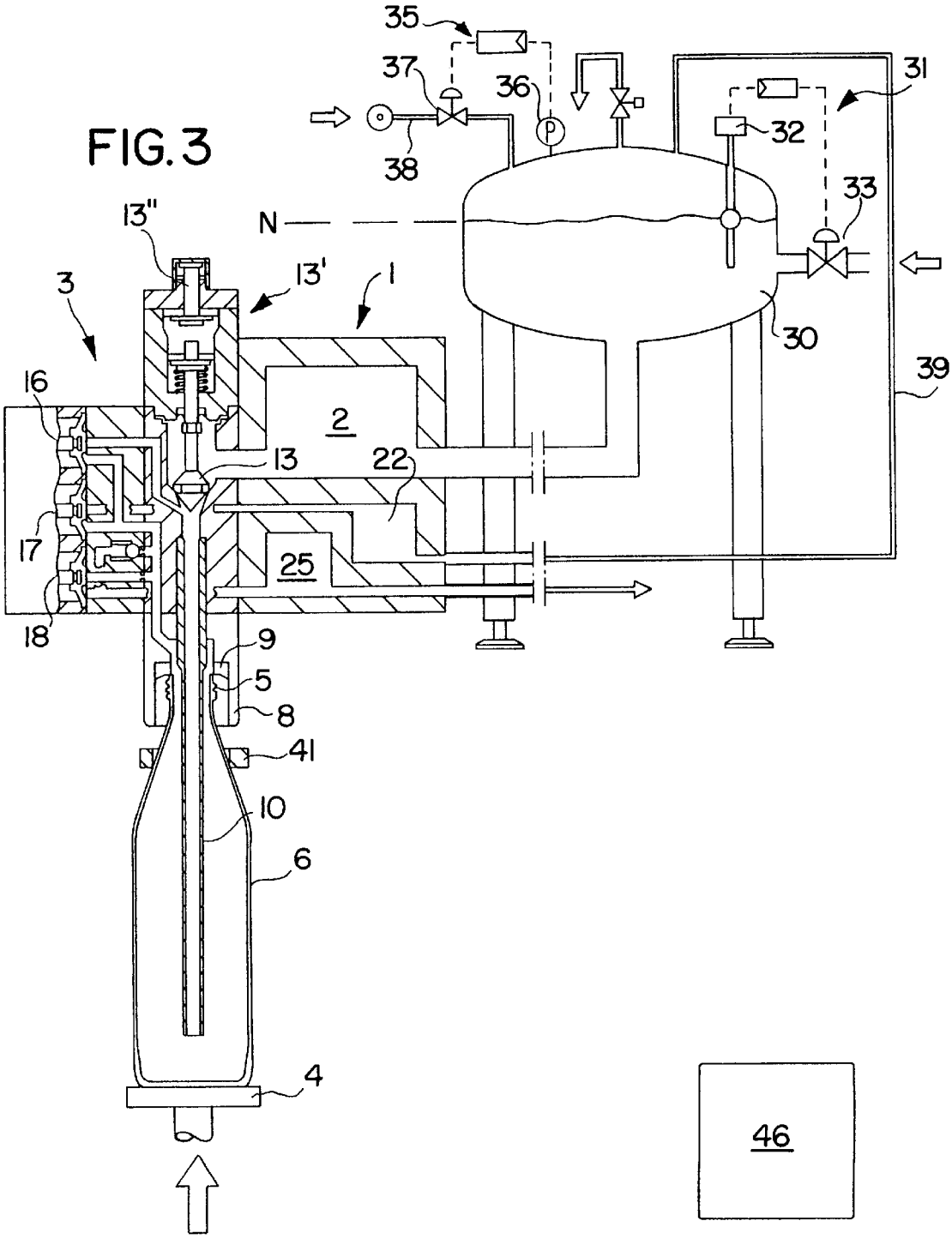
FIG. 3 shows the filling element illustrated in FIG. 1 as used for a single-chamber pressurized bottling.

The non-pressurized bottling and the single-chamber pressurized bottling that can be performed using the system illustrated in FIGS. 2 and 3 are described in greater detail below.

1. Non-pressurized bottling operations under protective gas (sterile bottling)

This type of bottling is suitable for the following products in particular:

fruit juices and fruit juice beverages (cold bottling under clean room conditions), sports beverages;

iced tea;

uncarbonated water that meets strict microbiological requirements; and wine (cold sterile).

This variant of the method, in which as illustrated in FIG. 2 the toroidal duct 25 is connected by means of a pressure regulator 40 with a source for a protective gas or inert gas and a slight protective gas overpressure is thereby set in the toroidal duct 25, comprises the following process steps:

1.1 Elevation of the bottle to the filling element and flushing with protective gas Immediately after the respective bottle 6 has been positioned on the bottle inlet of the bottling machine underneath the respective filling element 3, as it might be, for example, with the holder 41 that is provided in each filling position against the side of the bottle, the bottle is held and centered below the mouth of the filling position. When the bottle has not yet been raised against the filling element 3, i.e. when the mouth 5 of the bottle is still at some distance below the underside of the filling element, although with the fill tube 10 already in the interior of the bottle 6, flushing or protective gas flows via the two open control valves 16 and 18 out of the toroidal duct 25 via the ducts 24, 26, 19 and 14 both on the lower open end of the fill tube 10 (Arrow A in FIG. 2) as well as on the ring-shaped opening 15 (Arrow B in FIG. 2).

As the bottle 6 is raised further, and as the fill tube 10 penetrates increasingly deeper into the bottle, a large part of the air contained in the interior of the bottle 6 is replaced by the sterile flush gas and any micro-organisms contained in the bottle 6 are displaced outward. This flushing process continues until the bottle 6 is in its position of maximum elevation, i.e. with its mouth 5 located by the bell-shaped shelter 8' formed by the centering element 8, and namely with a slight distance between the mouth 5 and the gasket 9. The upper stop for the bottle is formed by the holder 41. The bottle 6 remains in this position until the filling has been completed.

1.2 Low-speed filling

With the control valves 16–18 closed, the liquid valve 13 is pneumatically partly opened, i.e. by a limited valve or opening movement. For this purpose, the limiting cylinder 13" of the actuator device 13 is activated.

The product flows at a reduced speed via the liquid valve 13 opened with the limited valve hub and the fill tube 10 into the interior of the bottle 6, where it makes a "soft landing" on the bottom of the bottle. Until the lower end of the fill tube 10 is submerged beneath the rising product level, the filling process remains slow and creates little turbulence. In this case, it is not necessary to pressurize the mouth 5 with protective gas, because the gas displaced from the bottle 6 by the incoming product prevents the entry of outside air. In addition, the mouth 5 of the bottle is enclosed in the bell-shaped shelter 8'.

1.3 High-speed filling

The limiting cylinder 13' is deactivated by a timing function, so that when the actuator device 13' remains activated, the liquid valve 13 opens all the way and thus the filling of the middle portion of the bottle 6, which portion is generally cylindrical and not critical, is performed at a high bottling speed. The result, overall, is an increase in the speed of the process. The length of this high-speed filling phase is again timed, specifically as a function of the specific type of bottle.

1.4 Decelerating filling

In the tapered neck of the bottle, the filling speed is then reduced to the value of the low-speed filling (No. 1.2). For this purpose, the limiting cylinder 13" is again activated by the control system, so that the liquid valve 13 is again opened with the limited travel.

During this decelerating filling, the level of the product rises with a uniform surface and without significant foaming to the fill-level probe 10' that is integrated in the fill tube 10. Bubbles that are formed during the high-speed filling, for example, can rise to the surface.

The sub-surface filling using the long fill tube 10 guarantees, even with intensely foaming products, that at the end of the filling process, there will be no foam or only small amounts of foam on the surface of the product. This also makes possible a very precise and repeatable determination of the fill level by the probe 10' and thus excellent accuracy of the fill level. After the probe 10' responds, the liquid valve 13 is closed.

1.5 End of filling and capping with protective gas pressurization

When the liquid valve 13 is closed, the gas current out of the respective bottle 6, which gas current also protects the open mouth of the bottle, also ends. To maintain a protective function immediately after the end of the filling, the control valve 18 opens, so that a flush gas current is released via the gas duct 14 and the annular orifice 15 into the shelter 8' that surrounds the mouth 5.

1.6 Lowering of the bottle and emptying of the fill tube

As soon as the bottle 6 is lowered by the bottle plate 4, and with the control valve 18 open, the control valve 16 is also opened, so that flushing gas is released on one hand, throttled through the nozzle 26, out of the annular orifice 15, and on the other hand gets into the fill tube 10 via the gas duct 14 and the ducts 19 and 20, so that the product remaining in the fill tube runs cleanly into the bottle 6 when the bottle is lowered. The gas to ventilate the fill tube thereby does not come from the surrounding atmosphere, but from the toroidal duct 25 that is supplied with the inert or protective gas.

1.7 Pressurization of the filling element with protective gas

After the bottle 6 has been completely lowered from the filling element and removed from the corresponding filling position at the bottle outlet of the bottling machine, the fill tube 10 and the shelter 8', in particular also in the area of the annular orifice 15 located there as well as the external surface of the fill tube 10 in the vicinity of the shelter 8', continue to be flowed over by the cover or inert gas. For this purpose, the control valves 16 and 18 remain open. So that a continuous shielding of all critical areas of the filling element 3 with respect to the ambient air and any micro-organisms that may be present, this state is maintained even after the introduction of a new bottle 6 into the filling site formed by the filling element in question 3 as the repeated process step entitled "Elevation of the bottle to the filling element and flushing with protective gas" (No. 1.1).

For a CIP cleaning, appropriate CIP or flushing caps are placed on the filling elements 3. These caps create an external seal on the filling element 3, so that the respective shelter 8' and its interior surfaces are fully included in the CIP cleaning. During the cleaning and the sterilization cycles, all the gas and beverage paths inside the bottler and the filling elements 3 are flowed through in a sequence controlled by the central computer, and are thus returned to correct hygienic condition.

The variant of the method described above is suitable in particular for the bottling of non-carbonated beverages into PET bottles or into other containers or bottles which have thin walls to reduce their cost or empty weight and have a reduced strength, and in particular cannot be pressed against a filling element with high forces. The variant of the method described above is also suitable in particular for the hot bottling of beverages in PET bottles, the dimensional stability and thus the axial strength of which decrease with increasing temperature. A firm pressing of the respective bottle 6 with its mouth 5 against the respective filling element is unnecessary in the variant of the method described above, in particular on account of the realization of the filling element 3 in the form of a long fill tube element. The respective bottle 6 can stand freely on the bottle plate 4 and is held only by the holder 41. As a result of the protective gas pressurization described above, a contamination of the mouth area in particular and of the interior of the respective bottle by micro-organisms from the environment can be effectively prevented. If the holder 41 is used, it can also be ensured that during the entire bottling process, there is no direct contact between the respective bottle 6 and the fill tube 10, or with the centering element 8 or the surfaces on it.

2. Pressurized bottling via the reservoir 30

This method is suitable in particular for carbonated non-alcoholic beverages and soft drinks (e.g. cola beverages);

carbonated mineral water; and carbonated fruit drinks.

In this variant of the method, as illustrated in FIG. 3, the gas space in the reservoir 30 is pressurized with a controlled overpressure above the level N, and in particular with carbon dioxide gas, for example, or a mixture of carbon dioxide and air. In this variant of the method, the toroidal duct 25 is used as a relief duct and is connected with the atmosphere.

This variant of the method comprises the following steps in particular:

2.1 Attach the bottle to the filling element

After the bottle 6 is raised by the bottle plate, the mouth 5 is sealed in a gas-tight manner on the filling element 3. All the control valves 16–18 as well as the liquid valve 13 are closed.

2.2 Preliminary pressurization

The respective bottle 6 is pre-pressurized via the duct 39 and the toroidal duct 22 from the gas space in the reservoir 30. For this preliminary pressurization, the control valve 17 is opened for a specified length of time, so that carbon dioxide gas can flow via the duct 21, the open control valve 17 and the gas duct 14 into the bottle 6. The length of time the control valve 17 is open is selected as a function of the volume of the bottle 6 and the pressure in the reservoir 30, so that during this preliminary pressurization period, a pressure equalization between the bottle 6 and the reservoir 30 takes place.

2.3 Low-speed filling

With the control valves 16–18 closed, the liquid valve 13 is opened all the way and the limiting cylinder 13" is not activated. The liquid product flows at a reduced rate of speed via the fill tube 10 into the bottle 6, where it is in turn deposited on the bottom of the bottle gently and without much turbulence. The low filling speed is achieved because the mixture of carbon dioxide and air displaced by the incoming product from the interior of the bottle 6 can flow only in a throttled manner via the throttle 28 and the pressure control valve 29 into the duct 24, and via that duct into the unpressurized toroidal duct 25 which is at atmospheric pressure, for example, and is used for pressure relief. This low-speed filling phase is continued until the lower end of the fill tube 10 is below the rising level of the surface of the product.

The low-speed filling is ended at a specified time.

2.4 High-speed filling

The cylindrical middle portion of the respective bottle 6 is filled at a higher volume per unit of time. For this purpose, with the control valves 16 and 18, the control valve 17 is opened, so that an additional, unthrottled gas path is created into the toroidal duct 22 that serves as the pressurization gas duct and is connected to the gas space of the reservoir 30. A gas path to the toroidal duct 25 also exists via the throttle 28 and the pressure control valve 29.

The filling speed during the high-speed filling phase thus results essentially from the static level of the product that is set in the reservoir 30. Taking into consideration the respective volume of the bottle 6, and taking into consideration the type of bottle, this high-speed filling phase is in turn set for a specified length of time which is determined by a timing device.

2.5 Decelerating and make-up filling

In the tapering neck of the bottle, the filling speed is again reduced to the value of the slow starting phase (No. 2.3). For this purpose, the control valve 17 is closed, so that the air-gas mixture displaced from the bottle again flows through the throttle 28 and via the pressure control valve 29 into the toroidal duct 25. Bubbles that have formed during the high-speed filling phase as a result of turbulence in the product, now rise rapidly to the surface of the product. The level of the product finally reaches the probe 10' without foam and with a flat surface.

2.6 End of filling and preliminary depressurization

As soon as the rising level of product has reached the probe 10', a signal that results in the closing of the liquid valve 13 is generated.

After the closing of the liquid valve 13, there is still a throttled connection via the throttle 28 with the toroidal duct 25. The pressure control valve 29 that is located in series with the throttle 28 is set so that the pressure in the neck of the bottle decreases to a specified pressure level. This pressure level is preferably significantly less than the carbon dioxide saturation pressure of the product being bottled.

In this preliminary depressurization and calming phase, therefore, all the bubbles formed in the product rise rapidly to the surface. The slight overpressure compared to the atmosphere maintained in the head space of the bottle 6 by the valve 29 prevents any significant foaming.

Compared to known pressure-relief and calming methods, this controlled preliminary pressure relief has the advantage that it takes place more rapidly and more uniformly, and it also sharply limits the undesirable foaming in the head space of the bottle. The preliminary depressurization and calming in turn takes place during a length of time set by a timing device.

2.7 Residual depressurization

For this residual depressurization, with the control valves 16 and 17 closed, the control valve 17 is opened so that the head space of the bottle 6, i.e. the interior of the bottle 6 above the surface of the product, is in communication via the throttle 26 with the toroidal duct 25. The throttle 26 thereby guarantees a smooth reduction of the pressure. Because the starting pressure for this residual pressure relief is already significantly below the bottling pressure, and preferably also below the carbon dioxide saturation pressure, during the residual pressure relief additional foam in the head space of the bottle is formed only to a minor and negligible extent. Spattering losses are essentially eliminated.

2.8 Lowering the bottle and emptying the fill tube

As soon as the interior of the bottle 6 has reached atmospheric pressure or approximately atmospheric pressure, and the bottle 6 on the bottle plate 4 has been lowered, the control valve 16 is opened so that a gas connection is created between the fill tube 10 and the annular orifice 15 to the atmosphere, and thus the product in the fill tube can flow cleanly out of the fill tube and into the bottle 6.

3. Pressurized bottling according to the three-chamber bottling principle

This variant of the method can be used for the following products in particular:

soft drinks and/or beer;

soft drinks that are sensitive to oxygen; and microbiologically sensitive soft drinks.

Figure 4:
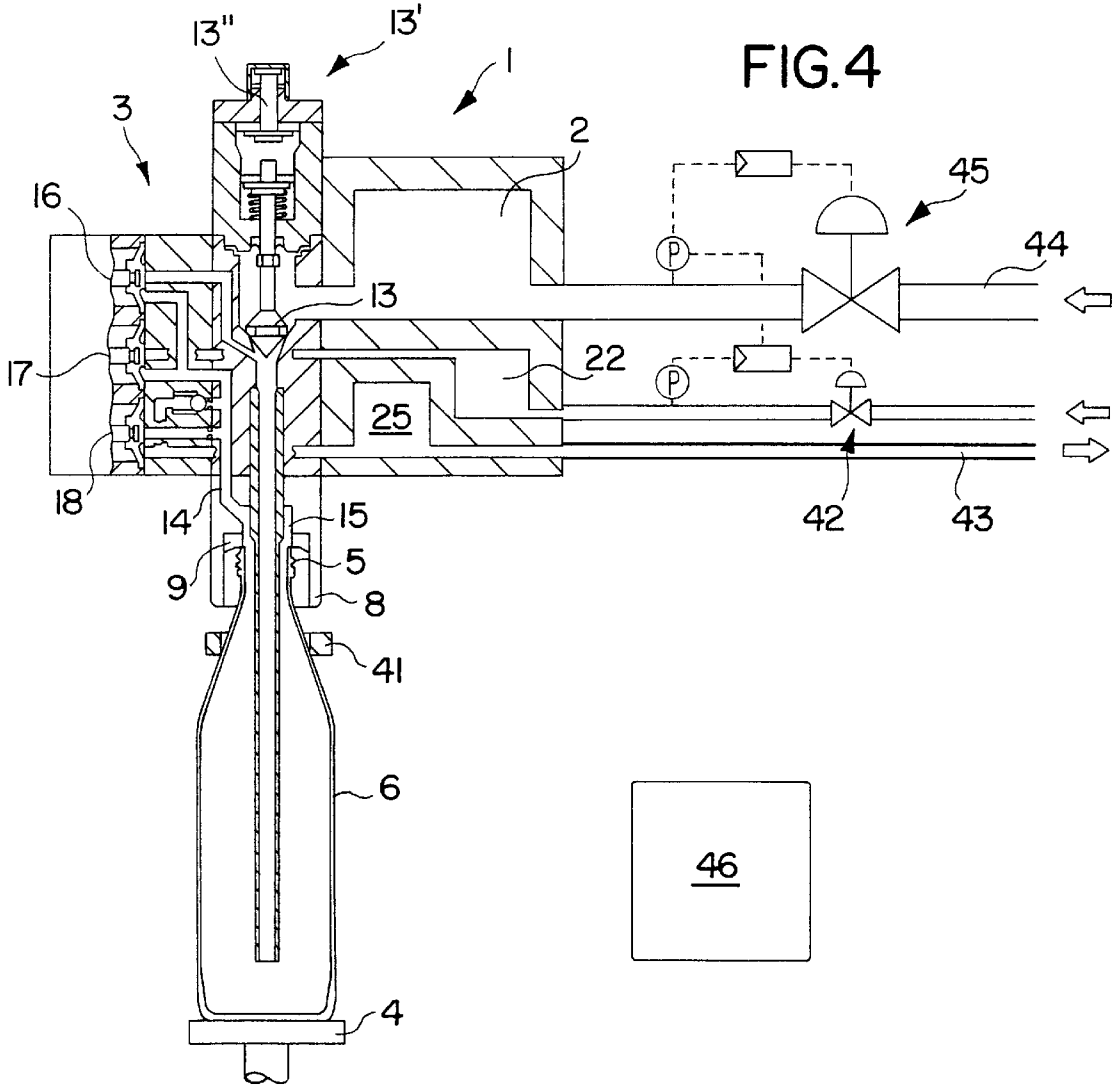
FIG. 4 shows the filling element illustrated in FIG. 1 as used for a three-chamber pressurized bottling.

In this variant of the method, the bottling system is used in the form illustrated in FIG. 4. In this case, the toroidal duct 22 used as the pressurization gas duct is connected by means of a pressure regulator 42 in the supply line 43 with a source for a fresh pressurization or inert gas under pressure, such as carbon dioxide gas. In this variant method, which is described in greater detail below, therefore, exclusively fresh inert gas taken from the toroidal duct 22 (pressurization gas duct) is used for the preliminary pressurization of the respective bottle 6. As a result, a high inert gas concentration, e.g. a high concentration of carbon dioxide, in the bottle 6 is guaranteed during the filling process. The oxygen absorption in the product (beverage) is correspondingly low. This variant also substantially guarantees that no gas that was already in the bottle will flow back into a gas chamber that comes into contact with the product. All or substantially all the gases that are displaced by the product flowing into a bottle 6 are transported directly into the atmosphere via the toroidal duct 22 that is in direct communication with the atmosphere. Contamination caused by re-used gas can therefore be practically eliminated.

The product is delivered via a supply line 43 with a pressure controller 45 directly to the interior 2 of the toroidal bowl 1, namely so that this interior 2 is in turn filled with the product completely and without a gas space. The pressure regulators 42 and 44 are set so that the filling pressure in the interior 2 is higher than the pressure in the toroidal duct 22 (pressurization gas duct) by a small, constant value. For this purpose, the two pressure regulators 42 and 44 are connected to one another in the illustrated embodiment.

This variant of the method, in which the reservoir 30 is not used, can comprise the following individual process steps:

3.1 Pressing of the bottle against the filling element

The respective bottle 6 is raised by the bottle plate 4 and is pressed and sealed with its mouth 5 in gas-tight contact against the filling element 3 or against the gasket 9 in the centering element 8.

3.2 Preliminary pressurization via the neck of the bottle

For this purpose, the control valve 17 is opened, so that a connection is created out of the toroidal duct 22 and via the ducts 21 and 14 between the interior of the bottle 6 and the duct 22. The bottle 6 is pre-pressurized with fresh inert gas to the specified pressure of the toroidal duct 22.

3.3 Low-speed filling

With the control valves 16–18 closed, the liquid valve 13,is opened. The limiting cylinder 13" is not activated, so that the liquid valve 13 is all the way open. By means of the constantly open, throttled connection which is formed by the connecting duct 27 with the throttle 28 and the valve 29, the gas displaced by the product flowing into the bottle 6 flows into the toroidal duct 25 (return gas duct). In this variant of the method, the pressure control valve 29 has practically no effect.

The product flows at a reduced speed via the fill tube 10 into the bottle 6, and is again deposited gently and with little turbulence on the bottom of the bottle. The speed of flow or filling during this initial filling phase is determined by the cross section of the throttle 28, among other things.

The bottling phase, which generates little turbulence and few bubbles, ends when the bottom end of the fill tube 10 is below the level of the product, and is terminated on the basis of a timing that is specific to the type of bottle being used.

3.4 High-speed filling

To increase the filling speed in the non-critical and generally cylindrical middle part of the bottle 6, the control valve 18 is opened, so that a connection now exists via both throttles 26 and 28 with the toroidal duct 25 (gas duct). The length of the high-speed filling phase is again determined on the basis of a timing that is specific to the type of bottle being filled.

3.5 Decelerating filling

In the tapering neck of the bottle, the speed of filling is decreased to the value of the initial filling phase. For this purpose, the control valve 18 is closed, so that the interior of the bottle 6 is in communication with the toroidal duct 25 (return gas channel) only via the throttle 28. Under these conditions, the level of product rises slowly and with a smooth and low-foam surface. As soon as the level of the product in the bottle reaches the probe 10 or the probe contact, a closing signal is generated for the closing of the liquid valve 13.

3.6 End of filling and preliminary depressurization

After the closing of the liquid valve 13, the pressure in the bottle 6 is reduced via the pressure control valve 29 to the preliminary depressurization pressure set with this valve. This preliminary depressurization pressure is set so that it is in the vicinity of the carbon dioxide saturation pressure, for example, or even significantly below said level.

Bubbles that form in the product during the decrease in pressure then rise rapidly. The slight, controlled overpressure (preliminary depressurization pressure) thereby substantially prevents any significant foaming. With sensitive beverages, this preliminary depressurization pressure is maintained for a specified time, to further calm the beverage and to keep the foaming within limits. This method is in particular advantageous when carbonated beverages are being bottled at elevated temperatures.

3.7 Residual depressurization

Following the completion of the preliminary depressurization, the control valve 18 is opened so that the pressure in the bottle 6 is reduced in a throttled manner via the throttle 26 to the pressure in the toroidal duct 25, i.e. to atmospheric pressure. On account of the low initial pressure, hardly any additional foam is formed during this residual depressurization, even with sensitive beverages. Spattering losses are substantially eliminated.

3.8 Lowering the bottle and emptying the fill tube

To empty the fill tube 10, the control valve 16 is opened, whereupon a connection to the fill tube 10 is created via the gas duct 14 to the annular orifice 15 and thus, when the bottle 6 is lowered, to the atmosphere. The product still in the fill tube 10 therefore flows directly into the bottle 6 when the bottle is lowered.

In all the variants of the method described above, during the decelerating filling after the response of the probe 10', the liquid valve 13 is closed with a delay, for example, that can preferably be set or changed while the bottling machine is running by means of a corresponding input at a user terminal, as a result of which it is then possible to correct the fill level.

As described above, when the bottling method is "non-pressurized bottling under protective gas", the holder 41 is controlled so that the holder 41 centers the respective bottle with respect to the fill tube 10 or its axis, and holds the bottle 6 attached to the filling element 3 with its mouth at some distance from the gasket 9, while when the bottling method is either "single-chamber pressurized bottling" or "three-chamber pressurized bottling", the holder 41 is used to center the respective bottle 6, although during the actual filling, the bottle 6 is pressed with its mouth 5 in a sealed position against the gasket 9 of the filling element 3.

The bottling system as claimed by the invention was explained above as it relates to three different variants of the method. All of the variants of the method have in common the fact that timings, in particular timings related to the type of bottle or the type of product being bottled, can be set individually on the control unit or the bottling machine or the control device 46 of this bottling machine, and/or can be set in the control device 46 by inputting the type of bottle and/or the type of product, namely, for example, taking into consideration the data stored in a memory of the control device 46.

One feature of the invention resides broadly in the bottling system to fill bottles or similar containers 6 with a liquid product, with a plurality of filling elements 3, with a common product chamber 2 for at least one group of filling elements 3, with a common first and second gas chamber 22, 25 for at least one group of filling elements 3, with a liquid duct 11 that is realized in a housing 7 of each filling element 3, which duct 11 is in communication with the product chamber 2 and empties into a fill tube 10 that forms a discharge opening for the product, which fill tube 10 projects beyond a container stop and/or centering device 8, 9 formed on the filling element 3, with a liquid valve 13 in the liquid duct 11, which valve can be individually actuated by means of an actuator element 13' by a central control device 46 at least for a group of filling elements 3, each of which can be actuated individually, and namely for an opening in the filling phase and for a closing at the end of the filling phase, with a gas-duct 14 that is realized in the housing 7 of each filling element 3, which gas duct 14 is in communication with a gas duct orifice 15 that is provided on the container stop 9 and is offset with respect to the fill tube 10, and when the container 6 is placed in sealed contact with the filling element 3 is in communication with the interior of the container, and with at least a first, second and third control valve, each of which can be actuated individually by the control device 46, to control gas paths that are realized in the housing 7 of each filling element 3, whereby a first control valve 16 is in communication on the input side via a first gas path 19 with an area of the liquid duct 11 that is downstream of the liquid valve 13 in the direction of flow of the product, characterized by the fact that the first valve 16 is connected on the output side to the gas duct 14, that a second control valve 17 is connected on the input side to a second gas path 21 leading to the first gas chamber 22, and on the output side to the gas duct 14, that a third control valve 18 is connected on the input side to the gas duct 14 and on the output side to a third gas path 24 leading to the second gas chamber 25, that between the gas duct 14 and the third gas path 24 or the second gas chamber 25, there is a fourth gas path 27 which has a pressure control valve 29 which, if the differential pressure applied to the pressure control valve 29 exceeds a specified threshold, opens to allow a flow out of the gas duct 14 into the third gas path 24 or into the second gas chamber 25.

Another feature of the invention resides broadly in the bottling system characterized by the fact that the product chamber 2 is the chamber of a toroidal bowl 1 that encircles the vertical machine axis and has the filling elements 3.

Yet another feature of the invention resides broadly in the bottling system characterized by the fact that the first gas chamber and the second gas chamber are annular ducts 22, 25 that are realized in a rotor of a rotating or revolving bottling machine. Still another feature of the invention resides broadly in the bottling system characterized by the fact that the actuator element 13' of the liquid valve 13 can be controlled so that the liquid valve 13 can assume at least three states, namely a first closed state to block the liquid duct 11, a second state in which the fluid valve 13 is opened with a reduced cross section, and a third state in which the liquid valve 13 is completely open.

A further feature of the invention resides broadly in the bottling system characterized by the fact that the liquid valve 13 has a valve body that can be moved in an axial direction, for example toward a filling element axis, which valve body can be moved by the actuator device 13, and that the actuator device 13' has a limiting element 13" which can be activated by the control device 46 so that when it is activated, it allows only a limited movement of the valve body.

Another feature of the invention resides broadly in the bottling system characterized by the fact that the actuator element 13' is a pneumatic actuator element such as a cylinder, and that the limiting element is a likewise pneumatically actuated limiting cylinder 13".

Yet another feature of the invention resides broadly in the bottling system characterized by the fact that the control valves 16–18 are pneumatically actuated valves, preferably valves actuated by membranes or membrane valves.

Still another feature of the invention resides broadly in the bottling system characterized by the fact that the pneumatic actuator element 13' and the pneumatically actuated control valves 16–18 can each be actuated by means of electro-pneumatic valves by the control device 46.

A further feature of the invention resides broadly in the bottling system characterized by a holder 41 on each filling element 3, which holder centers the container 6 that is raised and attached to the filling element with respect to the axis of the filling element or the fill tube 10.

Another feature of the invention resides broadly in the bottling system characterized by the fact that the holder 41 can be controlled so that it holds the container 6 with its mouth 5 at a distance from the container stop 9.

Yet another feature of the invention resides broadly in the bottling system characterized by the fact that the respective filling element 3 is a filling element with a long fill tube 10.

Still another feature of the invention resides broadly in the bottling system characterized by the fact that a bell-shaped element 8 is provided on the underside of the housing 7 of each filling element 3, which bell-shaped element 8 forms the container stop 9 inside a shelter or protected space 8' that opens toward the underside of the filling element 3.

A further feature of the invention resides broadly in the bottling system characterized by the fact that the threshold of the pressure control valve 29 is set to the difference between the preliminary relief pressure and atmospheric pressure.

Another feature of the invention resides broadly in the bottling system characterized by the fact that in the third gas path 24 there is a first throttle 26 to reduce the flow cross section.

Yet another feature of the invention resides broadly in the bottling system characterized by the fact that in the fourth gas path 27, in series with the pressure control valve 29, there is at least a second throttle 28 to reduce the flow cross section.

Still another feature of the invention resides broadly in the bottling system characterized by the fact that the product chamber 2 is connected with an additional, preferably external reservoir 30 which is filled with the liquid product up to a specified level N, which level is at least equal to and is preferably higher than the level of the upper side of the product chamber 2, whereby above the level N in the reservoir 30, a gas chamber is formed, and the first gas chamber 22 is in communication via a fifth gas path 39 with the gas chamber in the reservoir 30.

A further feature of the invention resides broadly in the bottling system characterized by the fact that on the reservoir 30 there is a level controller 31 to keep the level of the product in this reservoir constant.

Another feature of the invention resides broadly in the bottling system characterized by the fact that for an unpressurized filling of the containers 6 under protective gas, the second gas chamber is connected with a source for a protective gas at a regulated 40 pressure.

Yet another feature of the invention resides broadly in the bottling system characterized by the fact that there is a pressure regulator 40 in the connection between the second gas chamber 25 and the source for the protective gas under pressure.

Still another feature of the invention resides broadly in the bottling system characterized by the fact that for an unpressurized filling of the containers 6 under protective gas, the control valves 16–18 and the actuator element 13' of the liquid valve 13 are controlled by the control device 6 so that to flush the container, in particular in the interior as well as in the area of the mouth 5 of the container, the first and third control valves 16, 18 are opened to allow the flushing gas to exit the second gas chamber 25 at the lower end of the fill tube 10 and at the gas duct opening 15.

A further feature of the invention resides broadly in the bottling system characterized by the fact that for an initially low-speed filling, followed by a high-speed filling and a final decelerating filling in the mouth of the container, of the container 6 being held at a distance from the container stop 9, the control device 46 first controls the actuator element 13' to move the liquid valve 13 into the second state (opening with reduced cross section), then to move the liquid valve 13 into the third state (all the way open), then to move the liquid valve 13 into the second state (opening with reduced cross section), and finally to move the liquid valve 13 into the first state (closing of the liquid valve ) (first state).

Another feature of the invention resides broadly in the bottling system characterized by the fact that to empty the fill tube when the liquid valve 13 is closed, the first and third control valves 16, 18 are opened.

Yet another feature of the invention resides broadly in the bottling system characterized by the fact that the shelter 8' can be pressurized with the protective gas from the second gas chamber 25 by the control device 46, before the container 6 is removed from the filling element 3 by opening the third control valve 18.

Still another feature of the invention resides broadly in the bottling system characterized for the fact that for a filling of the container 6 under counter pressure using the single-chamber bottling principle, the gas chamber of the additional reservoir 30 is connected to a source for a pressurized gas.

A further feature of the invention resides broadly in the bottling system characterized by the fact that a pressure regulator 35 is provided in the connection between the pressurized gas source and the gas chamber of the reservoir 30.

Another feature of the invention resides broadly in the bottling system characterized by the fact that the second gas chamber 25 is open to the atmosphere.

Yet another feature of the invention resides broadly in the bottling system characterized by the fact that the control valves 16–18 and the actuator element 13' can be controlled by the control device 46 so that in a preliminary pressurization phase, to pre-pressurize the interior of the container 6 that is in sealed contact by means of its mouth 5 which is against the filling element 3, the second control valve is opened to create a connection between the gas duct 14 and the second gas path, that for a low-speed filling with closed control valves 16–18, the liquid valve 13 is fully opened, that for a subsequent high-speed filling the second control valve 17 is opened to create a connection between the gas duct 14 and the first gas chamber 21, and that for a subsequent decelerating filling and a preliminary pressure relief, all the control valves 16–18 are closed, and after the deceleration filling, the liquid valve 13 is switched into the first state for a preliminary depressurization pressure for the subsequent preliminary depressurization.

Still another feature of the invention resides broadly in the bottling system characterized by the fact that for a filling of the container 6 under counter pressure using the three-chamber filling principle, the product chamber 2 is connected via a pressure regulator 45 with a source for a product under pressure, and the first gas chamber 22 is connected via an additional pressure regulator 42 with a source for a pressurization gas under pressure, whereby the pressure regulators 42, 45 are set so that the bottling pressure in the product chamber 2 is equal to or preferably greater than the pressurization gas pressure in the first gas chamber 22, and that the second gas chamber 25 acts as the relief chamber, and is advantageously connected with the atmosphere.

A further feature of the invention resides broadly in the bottling system characterized by the fact that the actuator element 13' for the liquid valve 13 and the control valves 16–18 can be controlled by the control device 46 so that to pre-pressurize the respective container 6 brought into sealed contact with the filling element 3, the second control valve 17 is opened, that for a low-speed filling with closed control valves 16–18 the liquid valve 13 is opened, that for the subsequent high-speed filling the third control valve 18 is opened to create an additional connection from the interior of the reservoir into the second gas chamber 25, and that for a decelerating filling, the third control valve 18 is then closed, and for the preliminary depressurization with closed control valves 16–18, the liquid valve 13 is closed.

Another feature of the invention resides broadly in the bottling system characterized by the fact that the closing of the liquid valve 13 takes place with a specified delay after the response of a probe 10' that determines the level of the product.

Yet another feature of the invention resides broadly in the bottling system characterized by the fact that in the individual filling phases, the opening and/or the closing of the control valves 16–18 and/or of the liquid valve 13 takes place after a period of time determined by a timing, and that the timings are or can be set on the control device 46.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

U.S. Pat. No. 4,135,699, issued Jan. 23, 1979 to Petzsch et al., which may contain valves or valve components which may be used in embodiments of the present invention, is hereby incorporated by reference as if set forth in its entirety herein.

U.S. Pat. No. 5,713,403, issued Feb. 3, 1998 to Clüsserath et al., which may contain a rotary bottling machine as well as valves or valve components which may be used in at least one embodiment of the present invention, is hereby incorporated by reference as if set forth in its entirety herein.

U.S. Pat. No. 5,634,500 issued Jun. 3, 1997 to Clüsserath et al., which may contain valves or valve components which may be used in at least one embodiment of the present invention, is hereby incorporated by reference as if set forth in its entirety herein.

Examples of container filling machines and components thereof which may be used in accordance with embodiments of the present invention, may be found in the following U.S. Pat. No. 5,413,153, issued May 9, 1995; U.S. Pat. No. 5,558,138, issued Sep. 24, 1996; and U.S. Pat. No. 5,713,403, issued Feb. 3, 1998.

Examples of bottling systems, which may be used in or with embodiments of the present invention, may be found in the following U.S. Patents, which are hereby incorporated by reference, as if set forth in their entirety herein: U.S. Pat. No. 5,634,500, issued on Jun. 3, 1997 and entitled "Method for Bottling a Liquid in Bottles or Similar Containers"; U.S. Pat. No. 5,558,138, issued Sep. 24, 1996 and entitled "Process and Apparatus for Cleaning Container Handling Machines Such as Beverage Can Filling Machines"; and U.S. Pat. No. 5,713,403, issued Feb. 3, 1998 and entitled "Method and System for Filling Containers with a Liquid Filling Product, and Filling Machine and Labelling Device for Use with this Method or System". All of the above U.S. patent documents in this paragraph are assigned to KHS Maschinen- und Anlagenbau Aktiengesellschaft of the Federal Republic of Germany.

Examples of container labelling and/or filling machines and components and/or thereof and/or accesories therefor which may be used in embodiments of the present invention, may be found in the following documents, which are hereby incorporated by reference, as if set forth in their entirety herein: U.S. Pat. No. 4,944,830 issued on Jul. 31, 1990 and entitled "Machine for Labelling Bottles"; U.S. Pat. No. 4,911,285 issued on Mar. 27, 1990 and entitled "Drive for a Rotary Plate in a Labelling Machine for Bottles"; U.S. Pat. No. 4,976,803 issued on Dec. 11, 1990 and entitled "Apparatus for Pressing Foil on Containers, Such As on the Tops & the Necks of Bottles or the Like; U.S. Pat. No. 4,950,350 issued on Aug. 21, 1990 and entitled "Machine for Labelling Bottles or the Like"; U.S. Pat. No. 5,017,261 issued on May 21, 1991 and entitled "Labelling Machine for Objects Such as Bottles or the Like"; U.S. Pat. No. 5,062,917 issued on Nov. 5, 1991 and entitled "Support Element for the Followers of a Cam Drive of a Drive Mechanism & a Labelling Station Equipped With a Support Element"; U.S. Pat. No. 4,981,547 issued on Jan. 1, 1991 and entitled "Mounting & Drive Coupling for the Extracting Element Support of a Labelling Station for a Labelling Machine for Containers and Similar Objects"; U.S. Pat. No. 5,004,518 issued on Apr. 2, 1991 and entitled "Labelling Machine for Objects such as Bottles or the Like"; U.S. Pat. No. 5,078,826 issued on Jan. 7, 1992 and entitled "Labelling Machine for the Labelling of Containers"; U.S. Pat. No. 5,062,918 issued on Nov. 5, 1991 and entitled "Glue Segments which can be Attachable to a Drive Shaft of a Labelling Machine"; U.S. Pat. No. 5,227,005 and issued on Jul. 13, 1993 and entitled "Labelling Station for Labelling Objects, Such as Bottles"; U.S. Pat. No. 5,087,317 issued on Feb. 11, 1992 and entitled "Labelling Machines for the Labelling of Container"; U.S. Pat. No. 5,129,984 issued on Jul. 14, 1992 and entitled "Bottle Labelling Machine"; U.S. Pat. No. 5,185,053 issued on Feb. 9, 1993 and entitled "Brushing Station for a Labelling Machine for Labelling Bottles & the Like"; U.S. Pat. No. 5,075,123 issued on Dec. 24, 1991 and entitled "Process & Apparatus for Removing Alcohol From Beverages"; U.S. Pat. No. 5,217,538 issued on Jun. 8, 1993 and entitled "Apparatus & Related Method for the Removal of Labels & Foil Tags Adhering to Containers, in Particular, to Bottles"; U.S. Pat. No. 5,174,851 issued on Dec. 29, 1992 and entitled "Labelling Machine for Labelling Containers, Such as Bottles"; U.S. Pat. No. 5,110,402 issued on May 5, 1992 and entitled "Labelling Machine for Labelling Containers Such as Bottles Having a Labelling Box for a Stack of Labels in a Labelling Station"; U.S. Pat. No. 5,167,755 issued on Dec. 1, 1992 and entitled "Adhesive Scraper Which Can be Adjusted in Relation to an Adhesive Roller in a Labelling Machine"; U.S. Pat. No. 5,413,153 issued on May 9, 1995 and entitled "A Container Filling Machine for Filling Open-Top Containers, & A Filler Valve Therefor"; U.S. Pat. No. 5,569,353, issued on Oct. 29, 1996 and entitled "Labelling Machine & Apparatus for the Automatic Loading of the Main Magazine of a Labelling Machine, & A Supply Magazine Which Can Be Used in Such an Apparatus". All of the above U.S. patent documents in this paragraph are assigned to KHS Maschinen- und Anlagenbau Aktiengesellschaft of the Federal Republic of Germany.

Some additional examples of container filling systems, valves or methods and their components which may be incorporated in an embodiment of the present invention may be found in U.S. Pat. No. 5,425,402, issued on Jun. 20, 1995 and entitled "Bottling System with Mass Filling and Capping Arrays"; U.S. Pat. No. 5,450,882, issued on Sep. 19, 1995 and entitled "Beverage Dispensing Apparatus and Process"; U.S. Pat. No. 5,377,726, issued on Jan. 3, 1995 and entitled "Arrangement for Filling Bottles or Similar Containers"; U.S. Pat. No. 5,402,833, issued on Apr. 4, 1995 and entitled "Apparatus for Filling Bottles or Similar Containers"; U.S. Pat. No. 5,445,194, issued on Aug. 29, 1995 and entitled "Filling Element for Filling Machines for Dispensing a Liquid Filling Material into Containers." As well as, U.S. Pat. No. 5,241,996, issued to W. Heckmann et al. on Sep. 7, 1993; U.S. Pat. No. 5,190,084 issued to E. Diehl, et al. on Mar. 2, 1993, U.S. Pat. No. 5,195,331, issued to B. Zimmern, et al. on Mar. 23, 1993; U.S. Pat. No. 5,209,274, issued to R. La Warre on May 11, 1993; U.S. Pat. No. 5,217,680 issued to M. Koshiishi on Jun. 8, 1993; and U.S. Pat. No. 5,219,405 issued to W. Weiss on Jun. 15, 1993.

Some additional examples of methods and apparatuses for closing bottles and containers and their components which may be incorporated in an embodiment of the present invention may be found in U.S. Pat. No. 5,402,623, issued on Apr. 4, 1995, and entitled "Method and Apparatus for Closing Bottles"; U.S. Pat. No. 5,473,855, issued on Dec. 12, 1995 and entitled "System for Installing Closures on Containers"; U.S. Pat. No. 5,447,246, issued on Sep. 5, 1995 and entitled "Methods and Combinations for Sealing Corked Bottles"; U.S. Pat. No. 5,425,402, issued on Jun. 20, 1995 and entitled "Bottling System with Mass Filling and Capping Arrays"; U.S. Pat. No. 5,398,485, issued on Mar. 21, 1995, and entitled "Bottle Support Mechanism for a Capping Machine"; U.S. Pat. No. 5,419,094, issued on May 30, 1995 and entitled "Constant Speed Spindles for Rotary Capping Machine"; and U.S. Pat. No. 5,449,080, issued on Sep. 12, 1995 and entitled "Methods and Combinations for Sealing Corked Bottles."

Additional examples of bottle filling machines and components thereof which may be used in embodiments of the present invention may be found in the following U.S. Pat. No. 5,582,223; U.S. Pat. No. 5,533,552; U.S. Pat. No. 5,494,086; U.S. Pat. No. 5,454,421; U.S. Pat. No. 5,219,405; U.S. Pat. No. 5,191,741; U.S. Pat. No. 4,987,726; U.S. Pat. No. 4,967,813; U.S. Pat. No. 4,911,212; U.S. Pat. No. 4,653,249; U.S. Pat. No. 4,467,846; U.S. Pat. No. 4,446,673; U.S. Pat. No. 4,335,761; U.S. Pat. No. 4,136,719; and U.S. Pat. No. 3,946,770.

U.S. patent application Ser. No. 09/282,975, filed on Mar. 31, 1999, having the inventor Herbert Bernhard, claiming priority from Federal Republic of Germany Patent Application No. 198 14 625.6 which was filed on Apr. 1, 1998, and DE-OS 198 14 625.6 and DE-PS 198 14 625.6, are hereby incorporated by reference as if set forth in their entirety herein.

U.S. patent application Ser. No. 09/299,497, filed on Apr. 26, 1999, having the inventor Ludwig Clüsserath, and claiming priority from Federal Republic of Germany Patent Application No. 198 18 761.0 which was filed on Apr. 27, 1998, and DE-OS 198 18 761.0 and DE-PS 198 18 761.0, are hereby incorporated by reference as if set forth in their entirety herein.

U.S. patent application Ser. No. 09/300015, filed on Apr. 27, 1999, having the inventor Ludwig Clüsserath, claiming priority from Federal Republic of Germany Patent Application No. 198 18 762.9 which was filed on Apr. 27, 1998, and DE-OS 198 18 762.9 and DE-PS 198 18 762.9, are hereby incorporated by reference as if set forth in their entirety herein.

The corresponding foreign patent publication applications, namely, Federal Republic of Germany Patent Application No. 198 36 500, filed on Aug. 12, 1998, having inventor Ludwig Clüsserath, and DE-OS 198 36 500 and DE-PS 198 36 500, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means plus-function clause are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

NOMENCLATURE

1 Toroidal bowl
2 Toroidal bowl space
3 Filling element
4 Bottle plate
5 Bottle mouth
6 Bottle
7 Filling element housing
8 Centering element
8' Shelter
9 Gasket
10 Fill tube
10' Probe
11 Liquid duct
12 Passage
13 Liquid valve
13' Actuator element
13" Limit cylinder
14 Gas duct
15 Orifice
16–18 Control valve
19–21 Duct
22 Toroidal duct
23, 24 Duct
25 Toroidal duct
26 Throttle or nozzle
27 Duct
28 Throttle or nozzle
29 Pressure control valve
30 Reservoir
31 Level controller
32 Level controller
33 Control valve
34 Supply line
35 Pressure regulator
36 Pressure sensor
37 Control valve
38 Supply line
39 Duct
40 Pressure controller
41 Holder
42 Pressure controller

43, 44 Supply line
45 Pressure controller
46 Control device

What is claimed is:

1. A container filling system for filling containers with a liquid product, said container filling system comprising:

a plurality of filling elements for filling containers;

a product chamber configured to supply product to at least one group of said plurality of filling elements;

a first and second gas chamber being configured and disposed to supply gas to said at least one group of said plurality of filling elements;

each of said group of filling elements comprising a housing;

a liquid duct disposed in each said housing of said group of filling elements;

said liquid duct being in communication with said product chamber and disposed to empty into a fill tube that forms a discharge opening for a product;

a centering device to align a container with said fill tube;

said fill tube being configured and disposed to project beyond said centering device disposed on each said group of filling elements;

a valve to valve liquid;

said liquid valve being disposed in said liquid duct;

an actuator element to actuate said liquid valve;

said liquid valve being configured and disposed to be individually actuated by means of said actuator element to open in a filling phase and to close at the end of a filling phase;

a central control device being configured and disposed to actuate said actuator element of each said group of filling elements;

a container stop for holding a container;

a gas duct disposed in the housing of each said group of filling elements, said gas duct being in communication with a gas duct orifice disposed on said container stop and offset with respect to said fill tube;

said gas duct being in communication with the interior of a container upon a container being placed in sealed contact with at least one of said group of filling elements;

at least a first, second and third control valve, each of which is configured to be actuated individually by said control device, to control gas paths in the housing of each said group of filling elements;

said first control valve comprising an input side, said input side of said first control valve being in communication via a first gas path with an area of said liquid duct that is downstream of said liquid valve in the direction of flow of a product;

said first control valve comprising an output side, said output side being configured to be connected to said gas duct;

said second control valve comprising an input side, said input side of said second control valve being configured to be connected to a second gas path leading to said first gas chamber;

said third control valve comprising an input side and an output side, said input side of said third control valve being configured to be connected to said gas duct, said output side of said third control valve being configured to be connected to a third gas path leading to said second gas chamber;

a fourth gas path disposed between said gas duct and at least one of said third gas path and said second gas chamber;

a pressure control valve disposed in said fourth gas path; and said pressure control valve being configured and disposed to open to allow a flow out of said gas duct into at least one of said third gas path and said second gas chamber upon the differential pressure being applied to said pressure control valve exceeding a specified threshold.

2. The container filling system according to claim 1, wherein said product chamber comprises a toroidal bowl shape that encircles a vertical machine axis of said container filling system.

3. The container filling system according to claim 1, wherein said first gas chamber and said second gas chamber comprise annular ducts that are disposed in a rotor of a rotating bottling machine.

4. The container filling system according to claim 1, wherein said actuator element is configured and disposed to be controlled so that said liquid valve is configured to assume at least three states, said at least three states comprising (i), (ii), and (iii), where (i), (ii), (iii) are the following:

(i) a first closed state to block said liquid duct;

(ii) a second state in which said liquid valve is opened will a reduced cross section; and (iii) a third state in which said liquid valve is completely open.

5. The container filling system according to claim 4, wherein:

said liquid valve comprises a valve body, said valve body being configured and disposed to be moved along an operating axis of said group of filling elements;

said valve body is configured and disposed to be moved by said actuator element;

said actuator element comprises a limiting element configured and disposed to be activated by said control device so that when said limiting element is activated, said limiting element permits only a limited movement of said valve body.

6. The container filling system according to claim 5, wherein each of said actuator element and said limiting element is configured and disposed to be pneumatically actuated.

7. The container filling system according to claim 6, wherein said first, second, and third control valves are configured and disposed to be pneumatically actuated.

8. The container filling system according to claim 7, wherein:

said control device comprises electro-pneumatic valves; and said electro-pneumatic valves are configured and disposed to actuate each of said actuator element and said first, second, and third control valves.

9. The container filling system according to claim 8, wherein:

said electro-pneumatic valves comprise membrane valves;

each said group of filling elements further comprises a holder;

said holder is configured and disposed to center a container with respect to an operating axis of at least one of said group of filling elements and said fill tube.

10. The container filling system according to claim 9, wherein said holder is configured and disposed to hold the mouth of a container at a substantial distance from said container stop.

11. The container filling system according to claim 10, wherein said fill tube of at least one of said group of filling elements is substantially long.

12. The container filling system according to claim 11, wherein:

each said group of filling elements comprises an underside;

said underside comprises a shelter;

a bell-shaped element is disposed in said shelter; and said bell-shaped element is configured and disposed to surround a mouth of a container.

13. The container filling system according to claim 12, wherein the threshold of said pressure control valve is set to the difference between the preliminary relief pressure and atmospheric pressure.

14. The container filling system according to claim 13, wherein:

a first throttle is disposed in said third gas path; and said first throttle is configured and disposed to reduce the cross section of a flow of gas.

15. The container filling system according to claim 14, wherein:

at least a second throttle is disposed in said fourth gas path in series with said pressure control valve; and said at least second throttle is configured and disposed to reduce the cross section of a flow of gas.

16. The container filling system according to claim 15, wherein:

said product chamber is configured and disposed to be connected with a reservoir, said reservoir being configured to be filled to a predetermined level with a liquid product;

the predetermined level of liquid product in said reservoir is at least equal to a level of liquid product in the upper side of said product chamber to permit a gas chamber to be formed above the predetermined level of liquid product in said reservoir; and the first gas chamber is in communication via a fifth gas path with the gas chamber in said reservoir.

17. The container filling system according to claim 16, wherein a level controller is disposed on said reservoir to maintain a predetermined level of liquid product in said reservoir.

18. The container filling system according to claim 17, wherein:

each said group of filling elements comprises a source for providing a protective gas at a regulated pressure;

said second gas chamber is configured and disposed to be connected to said source to form a connection; and said connection is configured and disposed to permit an unpressurized filling of at least one container with a protective gas.

19. The container filling system according to claim 18, wherein a pressure regulator is disposed in said connection of said second gas chamber to said source.

20. The container filling system according to claim 19, wherein said container filling system further comprises at least one of (a), (b), (c), (d), (e), (f), (g), (h), (i), (j), (k), (l), (m), (n), and (o), where (a), (b), (c), (d), (e), (f), (g), (h), (i), (j), (k), (l), (m), (n), and (o) are the following:

(a) said first, second, and third control valves and said actuator element are configured and disposed to be controlled by said control device to flush a container in at least one of the interior and the area of the mouth of a container, said first and third control valves are configured to be opened to permit a flushing gas to exit said second gas chamber at the lower end of said fill tube and upon opening of said gas duct to permit an unpressurized filling of at least one container with protective gas;

(b) said control device is configured and disposed to drive said actuator element to move said liquid valve first into said second state, then secondly to move said liquid valve into said third state, then thirdly to move said liquid valve into said second state, and finally to move said liquid valve into said first state to permit an initially low-speed filling, followed by a high-speed filling and a final decelerating filling in the mouth of a container, of a container being held at a substantial distance from said container stop, c) said first and third control valves are configured to be open upon closing of said liquid valve to permit emptying of said fill tube;

(d) said shelter is configured and disposed to be pressurized by said control device with a protective gas from said second gas chamber, before removal of a container from said group of filling elements, by opening said third control valve;

(e) said gas chamber of said reservoir is configured and disposed to be connected to said source for providing pressurized gas to permit filling of a container under counter pressure using a single chamber;

(f) said second gas chamber is configured to be open to the atmosphere;

(g) each of said first, second, and third control valves and said actuator element are configured and disposed to be controlled by said control device so that in a preliminary pressurization phase, to pre-pressurize the interior of a container, upon the mouth of a container being in sealed contact with said group of filling elements, said second control valve is configured to be opened to permit a connection between said gas duct and said second gas path, for a low-speed filling with said first, second, and third control valves being closed, said liquid valve is fully opened, for a subsequent high-speed filling, said second control valve is opened to create a connection between said gas duct and said first gas chamber, and for a subsequent decelerating filling and a preliminary pressure relief, each of said first, second, and third control valves is closed, and after said deceleration filling, said liquid valve is switched into said first state for a preliminary depressurization pressure for said preliminary pressure relief;

(h) said product chamber is connected via said pressure regulator with a source for supplying said product chamber with a product under pressure, said first gas chamber is connected via another pressure regulator with said source for a pressurization gas under pressure, each of said pressure regulators is configured to be set to permit the bottling pressure in said product chamber to be equal to or greater than the pressurization gas pressure in said first gas chamber, and said second gas chamber acts as a relief chamber, to permit a filling of a container under counter pressure using three chambers;

(i) said product chamber is connected via said pressure regulator with a source for supplying said product chamber with a product under pressure, said first gas chamber is connected via another pressure regulator with said source for a pressurization gas under pressure, each of said pressure regulators is configured to be set to permit the bottling pressure in said product chamber to be equal to or greater than the pressurization gas pressure in said first gas chamber, and said second gas chamber acts as a relief chamber and is connected with the atmosphere, to permit a filling of a container under counter pressure using three chambers;

(j) said actuator element and each of said first, second, and third control valves are configured and disposed to be controlled by said control device so that to pre-pressurize a container in sealed contact with said group of filling elements, said second control valve is opened, for a low-speed filling upon closing of said first, second, and third control valves said liquid valve is opened, for a subsequent high-speed filling said third control valve is opened to permit an additional connection between the interior of said reservoir and said second gas chamber, for a decelerating filling, said third control valve is then closed, and for a preliminary depressurization upon closing said first, second, and third control valves, said liquid valve is closed;

(k) said liquid valve is configured to close within a predetermined time after a probe indicates that a liquid product is at its predetermined level;

(l) at least one of said first, second, and third control valves is configured to open within a predetermined time set on said control device;

(m) at least one of said first, second, and third control valves is configured to close within a predetermined time set on said control device;

(n) said liquid valve is configured to open within a predetermined time set on said control device; and (o) said liquid valve is configured to open within a predetermined time set on said control device.

* * * * *

UNITED STATES PATENT AND TRADEMARK OFFICE

CERTIFICATE OF CORRECTION

PATENT NO. : 6,192,946 B1
DATED : February 27, 2001
INVENTOR(S) : Ludwig Clüsserath It is certified that error appears in the above-identified patent and that said Letters Patent is hereby corrected as shown below:

Column 1,
Line 26, after 'with', delete "d" and insert -- a --.

Column 4,
Line 62, after 'reservoir', delete "1t" and insert -- 30 --.

Column 6,
Line 13, after 'cylinder', delete " 13' " and insert -- 13" --.

Column 15,
Line 66, after 'and/or', delete "accesories" and insert -- accessories --.

Column 20, claim 4,
Line 25, after 'opened', delete "will" and insert -- with --.

Signed and Sealed this

Twenty-sixth Day of March, 2002

*Attest:*

*Attesting Officer*

JAMES E. ROGAN
*Director of the United States Patent and Trademark Office*